United States Patent [19]

Goldberg

[11] Patent Number: 4,843,648

[45] Date of Patent: Jul. 4, 1989

[54] SLEEPER PAJAMAS

[76] Inventor: Stanley Goldberg, 20110 Boca West Dr., Boca Raton, Fla. 33434

[21] Appl. No.: 221,867

[22] Filed: Jul. 20, 1988

[51] Int. Cl.[4] ..... A41D 11/00

[52] U.S. Cl. ..... 2/80; 2/83; 36/9 R

[58] Field of Search ..... 2/80, 83, 111, 241, 2/239; 36/9 R, 90, 102, 112, 26

[56] References Cited

U.S. PATENT DOCUMENTS

| | | | |
|---|---|---|---|
| 387,035 | 7/1888 | Basch | 36/9 R |
| 1,189,665 | 7/1916 | Clear et al. | 36/112 |
| 2,188,265 | 1/1940 | Huels | 2/83 |
| 2,552,802 | 5/1951 | Martin | 2/83 X |
| 2,605,471 | 8/1952 | Kephart | 2/83 |
| 2,615,165 | 10/1952 | Steedman | 2/80 |
| 2,663,873 | 12/1953 | Stern | 2/83 |
| 2,705,804 | 4/1955 | Walker | 2/83 |
| 3,653,074 | 4/1972 | Nobile et al. | 2/80 |
| 3,863,272 | 2/1975 | Guille | 2/239 |

*Primary Examiner*—Werner H. Schroeder
*Assistant Examiner*—S. Current
*Attorney, Agent, or Firm*—Bert Lewen; Henry Sternberg

[57] ABSTRACT

Sleeper pajamas for a young child, including a garment of relatively soft and porous fleece-like cloth fabric having leg portions terminating in tubular distal ends sized for loosely surrounding the child's legs, and boot members of non-porous and wear-resistant material connected to the distal ends, each member including a sole and a counter having an instep portion overlying the sole and arranged to space the instep portion upwardly and outwardly from the child's instep and to space the top end of the counter outwardly from the leg, for relatively unhindered insertion of the foot into the member and unhindered air circulation between the member interior and leg portion interior located proximally of the distal end and surrounding the leg, while spacing the distal end sufficiently above the sole to avoid contact of the garment with a surface on which the child may walk or run.

8 Claims, 1 Drawing Sheet

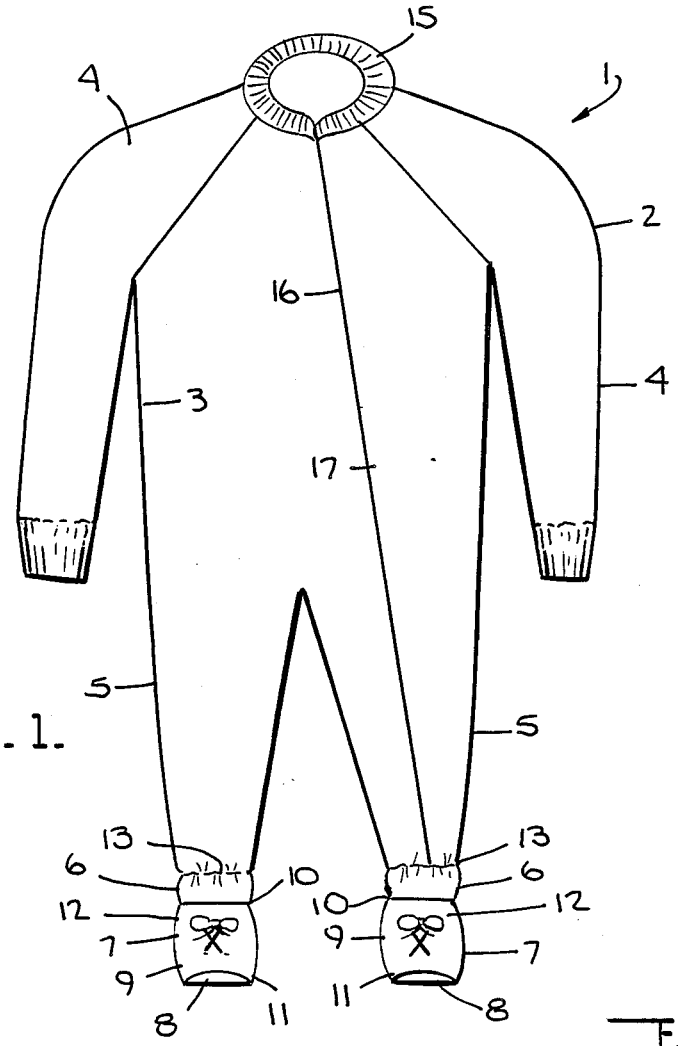
Fig. 1.
Fig. 2.
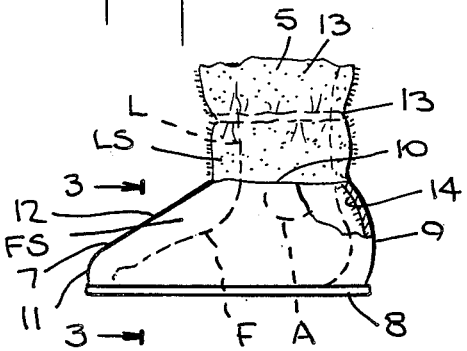
Fig. 3.
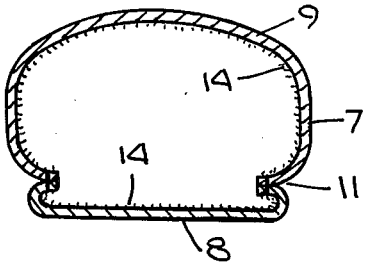
Fig. 2A.
Prior Art
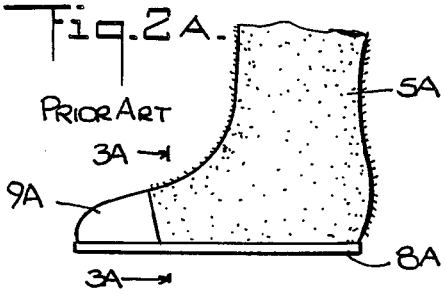
Fig. 3A.
Prior Art
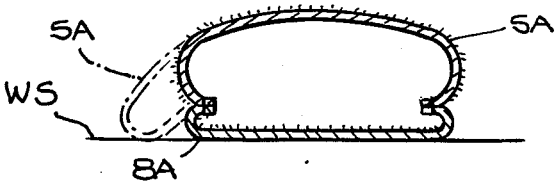

SLEEPER PAJAMAS

FIELD AND BACKGROUND OF THE INVENTION

The present invention relates to so-called sleeper pajamas, and more particularly to sleeper pajamas for a young child or toddler, which include a garment of relatively soft and porous fleece-like cloth fabric for covering the child's body, arms and legs, and protective boot members of non-porous and wear-resistant material connected to the leg portions of the garment so as to space such leg portions sufficiently above the soles of the boot members to avoid contact of the garment with a surface on which the child may walk or run.

Sleeper pajamas for a young child or toddler are known, and generally comprise a garment of relatively soft and porous fleece-like cloth fabric, such as washable polyester textile material, which offers heat insulation, physical protection, as well as "breathability", i.e. the ability to exchange air and moisture through the fabric, for the health and comfort of the child. The known sleeper pajamas typically include a body portion provided with a pair of arm portions and a pair of leg portions, so as to provide a sleeping and wearing enclosure for covering the child's body, arms and legs in loosely fitting manner.

The lower or distal ends of the loosely fitting leg portions of these known sleeper pajamas are usually provided with a flat sole of wear-resistant material, such as washable non-porous, pliable plastic sheeting material, and often a toe cap portion of the same wear-resistant material, overlying the toe portion of the sole and sewn thereto, to provide minimal support and protection for the toe area of the garment, with the remainder of the sole, extending from just behind the toe area, through the intermediate arch area, to the heel area thereof, being sewn directly to the leg portion of the soft cloth fabric of the garment.

A distinct feature of these so-called sleeper pajamas is that they contain flat soles of wear-resistant material, provided to enable the toddler to wear them, not only for sleeping per se, but also as "lounging pajamas" upon arising in the morning or after a nap, for walking or running around on the wear-resistant soles, instead of heaving to be changed first into some other attire.

However, a major problem with such known type sleeper pajamas is that in use, as when the toddler is out of bed and walking or running about, the immediate adjency of the loosely fitting leg portion of the soft garment to the flat sole is such that, since no side support is present, often the sole is displaced axially or distally, or laterally or sidewise, of the child's foot, causing the coextensive area of the leg portion of the garment to touch the surface on which the child is walking or running. Pointedly, this touching usually involves the curling or gather of the portion of the cloth fabric of the garment, immediately adjacent the margin of the sole, into a fold that finds its way under the sole.

This does not merely cause undue soiling of the bottom area of the garment material, but more important it also causes extensive and accelerated wear of the soft and porous fleece-like cloth fabric itself.

In this regard, it will be realized that the dynamic force generated by a walking or running small child is such that the touching portion of the garment fabric, especially a fold of the garment fabric displaced beneath the sole of the pajamas, will experience great squeezing pressure between the child's foot, or that sole, and the ground or other surface on which the child is walking or running, since the impulse, based on the child's dynamic weight as it is transmitted to the ground or other surface during walking or running, is concentrated in the very small area defined directly by the active foot of the child then contating the ground or such other surface, or indirectly by sole of the pajamas on which that active foot of the child is supported.

This is to be distinguished from the case where the infant merely crawls along the ground, since in crawling the child's weight is distributed among the extremities. Thus, at any given time the local impulse, for instance at a toe area or knee area touching the ground, will be only a fraction of the full impulse of an erect child transmitted to the ground via the given active foot.

While the soiling of the garment consequent such touching is readily corrected by suitable laundering of the sleeper pajamas, in that they are typically made of "machine-washable" material of the above noted type, e.g. washable polyester textile fabric material for the garment, and washable pliable plastic sheeting material for the sole and toe cap portion, whereupon they may be conveniently cleansed in the normal household or commercial washing machine, the resultant extensive and accelerated wear of such cloth fabric in the region of the sole of the sleeper pajamas cannot be corrected in this simple manner.

Instead, absent discarding the sleeper pajamas altogether, the worn portion of the garment must be repaired, such as by trimming away the worn section and rejoining the trimmed edges by stitching or the like, or by applying a sewn-on patch or the like to the worn area. In any case, the contemplated repairing necessarily alters the appearance and basic structure of the garment leg portion and of its relationship to the sole and toe cap portion.

The resulting appearance is often unsightly due to such trimming and sewing, patching, or like repair, but more significant the altered structure may be such that the composite, typically "brunched" or "bulged" rejoinder seam, or overlaid patch panel, containing fabric area is thicker and stiffer than the remainder of the fabric, as well as uneven, causing the garment areas and the sole and toe cap portion areas immediately surrounding the infant's foot to be locally changed in shape and/or size. This leads to discomfort of the infant during walking and running, analogous to that of an adult wearing shoes of the wrong size or wearing a shoe containing even a minute size pebble.

Moreover, since the underlying cause of the extensive and accelerated wear of the cloth fabric is not avoided by such repair measures, it is bound to recur, compounding the difficulties.

It would be desirable to provide sleeper pajamas of the above type for a young child, permitting relatively carefree walking or running of the child without fear of undue wear and other detriment to the soft and porous fleece-like material, and also permitting unhindered insertion of the foot into the portion of the pajamas in the vicinity of the sole and unhindered air circulation in the leg and foot enclosing portions thereof, while providing protection for the foot as well as for the garment leg portion adjacent thereto.

SUMMARY OF THE INVENTION

It is among the objects of this invention to provide sleeper pajamas for a young child or toddler in the form of a garment which is made of relatively soft and porous fleece-like cloth fabric, in which the leg portions of the garment are connected to protective boot members made of non-porous and wear-resistant material, each sized and shaped to permit relatively unhindered insertion of the foot thereinto and unhindered air circulation in the adjacent enclosed areas of the pajamas, and such that the boot members space the leg portions sufficiently above the boot member soles to avoid contact of the garment with a surface on which the child may walk or run.

It is among the additional objects of this invention to provide sleeper pajamas of the stated type, composed of a minimum of components, of serviceable and comparatively inexpensive construction, and readily produced from commercially available materials.

According to this invention, sleeper pajamas for a young child or toddler are advantageously provided, comprising a garment made of relatively soft and porous fleece-like cloth fabric, and having a body portion provided with a pair of leg portions and defining a sleeping and wearing enclosure, the leg portions terminating in tubular distal ends of selective size for loosely surrounding the child's legs, and a pair of boot members made of relatively stiff, yet pliable, non-porous, and wear-resistant sheeting material, and connected to the distal ends to enclose the child's feet.

The boot members each include a bottom sole of shape and size generally conforming to the feet, and a tubular upper counter having a top end of size generally corresponding to the distal ends and connected to a respective distal end, and a bottom end of shape and size generally conforming to the sole and connected thereto. The counter includes an instep portion overlying the sole and upwardly and inwardly inclined toward and extending to the top end sufficiently to space the instep portion inwardly and outwardly from the child's instep and to space the top end outwardly from the child's leg.

In this way, the arrangement permits relatively unhindered insertion of the foot into the botto member, and unhindered air circulation between the interior of the non-porous boot member surrounding the foot and the interior of the porous leg portion located proximally of the distal end and surrounding the leg, while spacing the distal end sufficiently above the sole to avoid contact of the garment with a surface on which the child may walk or run.

An elastic zone is desirably provided in each leg portion adjacent to but slightly spaced proximally from its distal end for inwardly resiliently drawing the leg portion into peripheral contact with the child's leg at a level spaced proximally from the ankle and forming an extension of the boot member between the counter top end and the elastic zone, such that the contact of the elastic zone with the leg serves to keep the sole from being displaced distally from the foot and the instep portion from being displaced distally into contact with the child's instep. The counter is conveniently sized in height to enclose the child's ankle.

Preferably, the boot members have an interior lining of soft, absorbent material, and the members are favorably permanently connected to the distal ends.

In the typical case, the garment has an insertion aperture for inserting the child therein, and closure means for closing and opening the aperture. More specifically, the garment usually has a neck opening, and the aperture is in the form of a slit extending from the neck opening toward and terminating proximally of the boot members, and the closure members includes a zipper mechanism or the like for closing and opening the slit.

BRIEF DESCRIPTION OF THE DRAWINGS

Other objects of the invention will become apparent from the within specification and accompanying drawings, in which:

FIG. 1 is a plan view of the sleeper pajamas according to an embodiment of the invention;

FIG. 2 is a side view of a boot member and lower leg portion of the garment forming the sleeper pajamas of FIG. 1, partially broken away to illustrate details of construction, and showing in phantom of the child's foot in relation to the adjacent part of the construction;

FIG. 3 is a sectional view taken along the line 3—3 of FIG. 2; and FIGS. 2A and 3A are side and sectional views, respectively, corresponding to FIGS. 2 and 3, but of sleeper pajamas according to the PRIOR ART, with FIG. 3A being taken along the line 3A—3A of FIG. 2A.

DESCRIPTION OF THE PREFERRED EMBODIMENTS

Referring to the drawings, and initially to FIG. 1, sleeper pajamas 1 for a young child, infant, or toddler, are shown, for instance including a garment 2 which is made of relatively soft and porous fleece-like cloth fabric, and which has a body portion 3 provided with a pair of arm portions 4 and a pair of leg portions 5, which components together define a sleeping and wearing enclosure for covering the child's body, arms and legs in generally loosely fitting manner.

These body, arm and leg portions 3, 4, and 5 are normally provided as tubular elements, and may be made of relatively soft and porous fleece-like cloth fabric, such as conventional "machine-washable" polyester textile material, which offers heat insulation, physical protection, as well as "breathability", i.e. the ability to exchange air and moisture through the fabric, for the health and comfort of the child, yet provides little in the way of wear-resistance or structural strength by reason of its very soft and porous nature.

In any case, leg portions 5 terminate in the tubular distal ends 6, which are of selective size or width for loosely surrounding the child's legs.

Pajamas 1 also include a pair of boot members 7 which are made of relatively stiff, yet pliable, non-porous, and wear-resistant sheeting material, such as a suitable conventional "machine-washable" imperforate, pliable plastic sheeting material, and which are connected to distal ends 6 of garment 2 so as to enclose and thus protect the child's feet, and at the same time provide significant structural strength and dimensional stability.

As shown more clearly in FIG. 2, each member 7 includes a bottom sole 8 of shape and size generally conforming to the feet, and a tubular upper counter 9, or "upper", e.g. of generally frusto-conical hollow configuration, having a top end 10 of size generally corresponding to distal ends 6 and connected to a respective distal end 6, and a bottom end 11 of shape and size generally conforming to sole 8 and connected thereto, e.g. along their coextensive margins.

Significantly, each counter 9 includes an instep portion 12 overlying its sole 8 and upwardly and inwardly inclined toward and extending to its top end 10 sufficiently to space such instep portion 12 upwardly and outwardly from the instep of the given child's foot F (shown in phantom in FIG. 2), thereby providing the foot space FS, and similarly sufficiently to space such top end 10 outwardly from the child's leg L (also shown in FIG. 2), thereby similarly providing the leg space LS.

This positional and spatial arrangement, and configuration and sizing, of the related components, regarding each leg portion 5 and boot member 7, advantageously permits relatively unhindered insertion of the corresponding child's foot F into member 7, as well as relative,ly unhindered air circulation between the interior of non-porous member 7 surrounding the foot F, e.g. at foot space FS, and the interior of porous leg portion 5 located proximally of its distal end 6 and surrounding the leg L, e.g. at leg space LS, while space its distal end 6 sufficiently above the associated sole 8 to avoid contact of garment 2 with a surface, such as a floor or the ground outdoors, on which the child may walk or run.

According to a desirable feature, shown in particular in FIG. 2, pajamas 1 are provided with an elastic zone 13, e.g. of conventional elastic strip or elastic binding material, in each leg portion 5 adjacent to but slightly spaced proximally from its distal end 6 for inwardly resiliently drawing such leg portion 5 into peripheral contact with the leg L at a level spaced proximally from the ankle A (shown in phantom in FIG. 2), and forming an extension of the associated member 7 between its counter top end 10 and such elastic zone 13. In this way, the contact of such elastic zone 13 with the leg L serves to keep the associated sole 8 from being displaced distally from the foot F and the associated instep portion 12 from being displaced distally into contact with the child's instep.

It will be further note from FIG. 2, in this regard, that each counter 9 is desirably sized in height to enclose the child's ankle A. Moreover, boot members 7 favorably have an interior lining 14 of conventional soft, absorbent material (FIGS. 2–3).

Boot members 7 are preferably permanently connected to distal ends 6, such as by stiching or other suitable connecting means, and in similar manner counters 9 are connected to soles 8 by suitable stitching or the like (cf. FIG. 3).

As shown in FIG. 1, in the typical case, garment 2 has a neck opening 15, and an insertion aperture for inserting the child therein, such as in the form of a slit 16 extending from neck opening 15 toward and terminating proximally of boot members 7, plus closure means for closing and opening slit 16 such as the zipper mechanism 17, or alternatively any other conventional closure means such as VELCRO connection mechanism, or the like.

It will be seen from the foregoing that the sleeper pajamas according to this invention may be readily manufactured from commercially available materials by conventional technique, using a minimum of components of serviceable and comparatively inexpensive construction, e.g. by sewing the various components together at their junction areas, using appropriately shaped and sized precut elements of said cloth fabric for the pertinent parts of garment 2 and of said sheeting material for the pertinent parts of boot members 7.

In contrast thereto, as shown in PRIOR ART FIGS. 2A and 3A, the typical conventional sleeper pajamas are provided with a garment of such soft and porous fleece-like cloth fabric which has a pair of leg portions 5A, only one of which is shown, which extend to and are connected directly to the flat bottom soles 8A, only one of which is shown, in the intermediate arch and heel areas of the given sole 8A, whereas the toe area of each such sole 8A is provided with a short overlying toe cap or toe guard 9A connected along its outer edge to the outer front edge portion of such sole 8A.

It is immediately clear that, although the foot of the infant may be inserted via the leg portion 5A onto the associated sole 8A, by reason of the soft and very pliable nature and "give" of the garment cloth fabric, difficulties will arise in attempting to insert the child's toes between the overlying toe guard 9A and the underlying sole 8A, considering the confined space thereat and the tendency for the child's toes to snag on the soft and very pliable garment cloth fabric in the immediate vicinity of such toe guard 9A and sole 8A.

Even so, once the child's foot is finally inserted in place, because of the very loosely disposed condition of the adjacent regions of the leg portion 5A around the lower end of the child's leg, there will be much play therebetween, rendering the leg prone to displacement axially or proximally of the sole 8A as well as laterally or sidewise of the sole 8A, especially leading to the laying over, folding, etc., of the side areas of the cloth fabric of the garment leg portion 5A and direct contact with the surface WS on which the infant may be walking or running (as shown in phantom in FIG. 3A), with consequent squeezing, distorting, and the like, of the soft cloth fabric thereat.

This causes accelerated stress and wear of the garment cloth fabric in the immediate vicinity of the sole 8A, and results in the accelerated failure of the conventonal type sleeper pajamas, as earlier described.

In complete contrast thereto, as is clear from FIG. 3, the construction of the sleeper pajamas 1 according to this invention, avoids all such prior art problems and adverse results, and provides the various advantages stated above.

It will be appreciated that the foregoing specification and accompanying drawings are set forth by way of illustration and not limitation of the present invention, and that various modifications and changes may be made therein without departing from the spirit and scope of the present invention which is to be limited solely by the scope of the appended claims.

What is claimed is:

1. Sleeper pajamas for a young child, comprising a garment made of relatively soft and porous fleece-like cloth fabric, and having a body portion provided with a pair of leg portions and defining a sleeping and wearing enclosure, the leg portions terminating in tubular distal ends of selective size for loosely surrunding the child's legs, and a pair of boot members made of relatively stiff, yet pliable, non-porous, and wear-resistant sheeting material, and connected to the distal ends to enclose the child's feet, the members each including a bottom sole of shape and size generally conforming to the feet, and a tubular upper counter having a top end of size generally corresponding to the distal ends and connected to a respective distal end, and a bottom end of shape and size generally conforming to the sole and connected thereto, the counter including an instep portion overlying the sole and upwardly and inwardly inclined toward and extending to the top end sufficiently to space the instep portion upwardly and outwardly from the child's instep and to space the top end outwardly from the leg, whereby to permit relatively unhindered insertion of the foot into the member, and unhindered air circulation between the interior of the non-porous member surrounding the foot and the interior of the porous leg portion located proximally of the distal end and surrounding the leg, while spacing the distal end sufficiently above the sole to avoid contact of the garment with a surface on which the child may walk or run.

2. Pajamas of claim 1 wherein an elastic zone is provided in such each leg portion adjacent to but slightly spaced proximally from its distal end for inwardly resiliently drawing the leg portion into peripheral contact with the leg at a level spaced proximally from the ankle and forming an extension of the member between the counter top end and the elastic zone, such that the contact of the elastic zone with the leg serves to keep the sole from being displaced distally from the foot and the instep portion from being displaced distally into contact with the child's instep.

3. Pajamas of claim 1 wherein the counter is sized in height to enclose the child's ankle.

4. Pajamas of claim 1 wherein the members have an interior lining of soft, absorbent material.

5. Pajamas of claim 1 wherein the members are permanently connected to the distal ends.

6. Pajamas of claim 1 wherein the garment has an insertion aperture for inserting the child therein, and closure means for closing and opening the aperture.

7. Pajamas of claim 6 wherein the garment has a neck opening, the aperture is in the form of a slit extending from the neck opening toward and terminating proximally of the members, and the closure means includes a zipper mechanism for closing and opening the slit.

8. Sleeper pajamas for a young child, comprising a garment made of relatively soft and porous fleece-like cloth fabric, and having a body portion provided with a pair of arm portions and a pair of leg portions and defining a sleeping and wearing enclosure for covering the child's body, arms and legs, the leg portions terminating in tubular distal ends of selective size for loosely surrounding the child's legs, and a pair of boot members made of relatively stiff, yet pliable, non-porous, and wear-resistant sheeting material, and connected to the distal ends to enclose the child's feet, the members each including a bottom sole of shape and size generally conforming to the feet, and a tubular upper counter having a top end of size generally corresponding to the distal ends and connected to a respective distal end, and a bottom end of shape and size generally conforming to the sole and connected thereto, the counter including an instep portion overlying the sole and upwardly and inwardly inclined toward and extending to the top end sufficiently to space the instep portion upwardly and outwardly from the child's instep and to space the top end outwardly from the leg, the counter being sized in height to enclose the child's ankle, and an elastic zone being provided in each leg portion adjacent to but slightly spaced proximally from its distal end for inwardly and resiliently drawing the leg portion into peripheral contact with the leg at a level spaced proximally from the ankle and forming an extension of the member between the counter top end and the elastic zone, such that the contact of the elastic zone with the leg serves to keep the sole from being displaced distally from the foot and the instep portion from being displaced distally into contact with the child's instep, whereby to permit relatively unhindered insertion of the foot into the member, and unhindered air circulation between the interior of the non-porous member surrounding the foot and the interior of the porous leg portion located proximally of the distal end and surrounding the leg, while spacing the distal end sufficiently above the sole to avoid contact of the garment with a surface on which the child may walk or run.

* * * * *